US009707676B2

(12) United States Patent
Chapman

(10) Patent No.: US 9,707,676 B2
(45) Date of Patent: Jul. 18, 2017

(54) ADAPTER TOOL WITH MULTIPLE ATTACHMENTS

(71) Applicant: Deone Lashawne Chapman, Fredericksburg, VA (US)

(72) Inventor: Deone Lashawne Chapman, Fredericksburg, VA (US)

( * ) Notice: Subject to any disclaimer, the term of this patent is extended or adjusted under 35 U.S.C. 154(b) by 66 days.

(21) Appl. No.: 14/740,893

(22) Filed: Jun. 16, 2015

(65) Prior Publication Data

US 2015/0360362 A1 Dec. 17, 2015

Related U.S. Application Data

(60) Provisional application No. 62/012,847, filed on Jun. 16, 2014.

(51) Int. Cl.
*B25F 1/02* (2006.01)
*B25F 1/00* (2006.01)
*B25H 3/00* (2006.01)

(52) U.S. Cl.
CPC ..... *B25F 1/02* (2013.01); *B25F 1/006* (2013.01); *B25H 3/006* (2013.01)

(58) Field of Classification Search
CPC ... B25F 1/02; B25F 1/006; B25F 1/00; B25D 2250/105; B25D 2250/111; B25D 2250/065; B25D 2250/361; B25D 1/02; B25D 1/00; B25D 1/14; B25G 1/00; B25H 3/006
USPC ..... 81/25, 26, 20, 19, 489; 7/145, 167, 143, 7/144
See application file for complete search history.

(56) References Cited

U.S. PATENT DOCUMENTS 1,307,018 A * 6/1919 Nomeland ..... B25F 1/00 7/142
1,493,055 A * 5/1924 Swangren ..... B25D 1/02 81/19
1,560,736 A * 11/1925 Salazar ..... B25D 1/02 30/308.3
1,784,683 A * 12/1930 Schweigert ..... B25D 1/02 81/20
2,601,294 A * 6/1952 Jahn ..... B25D 1/02 81/19
3,088,506 A * 5/1963 Bianchini ..... B25D 1/02 81/19
3,343,576 A * 9/1967 Norcross ..... B25D 1/02 81/19
3,721,282 A * 3/1973 Hayes ..... B25D 1/02 403/343

(Continued)

*Primary Examiner* — Hadi Shakeri
(74) *Attorney, Agent, or Firm* — Dunlap Bennett & Ludwig PLLC

(57) ABSTRACT

An adapter tool is provided. The adapter tool includes an elongated handle having a top end opposite a bottom end. A head is attached to and is substantially perpendicular with the handle. The head includes a first end opposite a second end. At least one of the first end and the second end may include a head mating end. The present invention further includes a plurality of tool attachments. Each of the tool attachments includes a tool mating end releasably attachable to the head mating end. Each of the plurality of tool attachments may include a tool portion including a different type of tool. Therefore, different tool attachments may be connected to the head to form different tools.

9 Claims, 6 Drawing Sheets

(56) References Cited

U.S. PATENT DOCUMENTS

| | | | | |
|---|---|---|---|---|
| 5,526,719 | A * | 6/1996 | Chen | B25D 1/02 30/308.3 |
| 6,347,562 | B1 * | 2/2002 | Gerber, Jr. | B25D 1/02 81/25 |
| 6,449,789 | B1 * | 9/2002 | Krass | B25B 15/00 7/138 |
| 6,463,832 | B1 * | 10/2002 | Cox | B25D 1/02 81/22 |
| 2002/0184713 | A1 * | 12/2002 | Dallas | B23D 57/0076 7/116 |
| 2006/0112789 | A1 * | 6/2006 | Hopper, Jr. | B25D 1/12 81/22 |
| 2006/0266165 | A1 * | 11/2006 | Moxey | E04H 17/265 81/143 |
| 2011/0239376 | A1 * | 10/2011 | Schmidt | A45B 3/00 7/167 |

* cited by examiner

ADAPTER TOOL WITH MULTIPLE ATTACHMENTS

CROSS-REFERENCE TO RELATED APPLICATION

This application claims the benefit of priority of U.S. provisional application No. 62/012,847, filed Jun. 16, 2014, the contents of which are herein incorporated by reference.

BACKGROUND OF THE INVENTION

The present invention relates to tools and, more particularly, to an adapter tool with multiple attachments.

A tool is any physical item that can be used to achieve a goal. Tool use by humans dates back millions of years. Tools that are used in particular fields or activities may have different designations such as "instrument", "utensil", "implement", "machine", "device," or "apparatus". The set of tools needed to achieve a goal is "equipment". Currently, most tools may only be used for a single purpose. Therefore, many tools must be purchased for different tasks, which is expensive and takes up a lot of space.

As can be seen, there is a need for an improved multi-purpose tool set adapter.

SUMMARY OF THE INVENTION

In one aspect of the present invention, a adapter tool comprises: a handle comprising a top end and a bottom end; a head attached to the top end of the handle and comprising a first end and a second end, wherein at least one of the first end and the second end comprises a head mating end; and a plurality of tool attachments, each comprising: a tool mating end releasably attachable to the head mating end; and a tool portion comprising a type of tool.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a tool handle and head adapted to secure different tool attachments, thereby creating different types of tools. The present invention is versatile, has many capabilities, and can be manipulated to create different types of tools, such as but not limited to, hammers, hacksaws, and mallets. The handle, head and tool attachments may be secured in a solid case. The present invention may save the consumer money and space.

The present invention may be used as a survival tool for those that enjoy camping and hunting. The present invention may also be used by carpenters, gardeners, campers, metal workings, archeologists, engineers, machinists, welders, survivalists, miners, mechanists, craftsmen, construction workers, and an everyday handy man and do it yourselfer.

Figure 1:
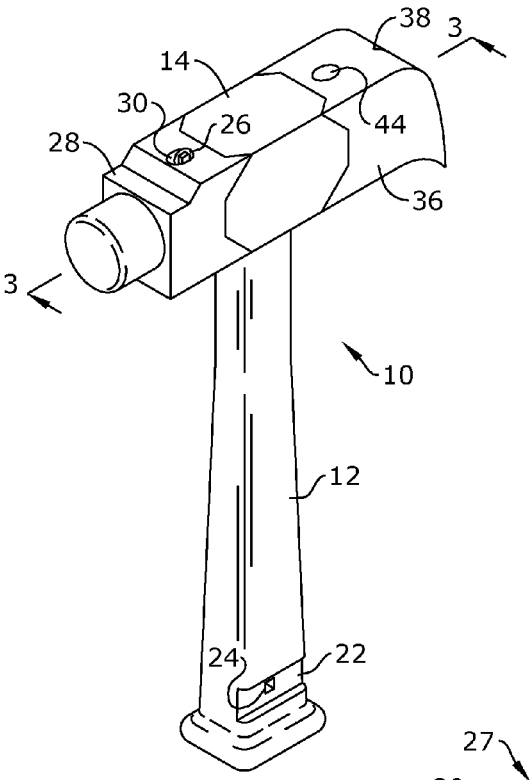
FIG. 1 is a perspective view of an embodiment of the present invention.
Figure 2:
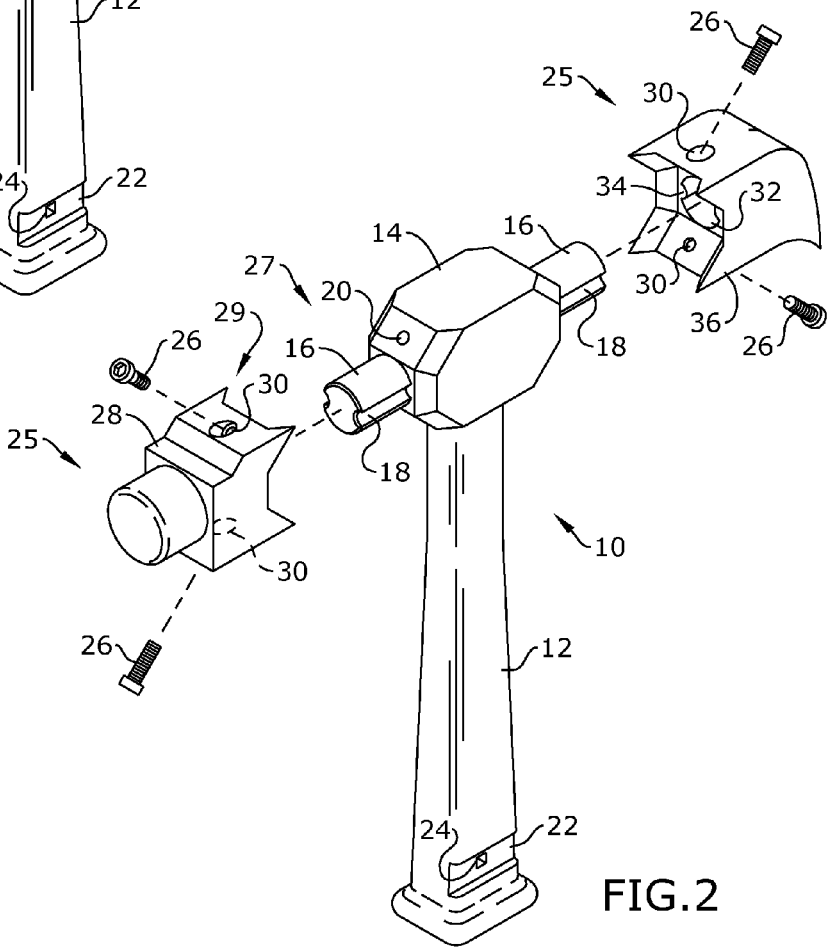
FIG. 2 is an exploded view of an embodiment of the present invention.
Figure 3:
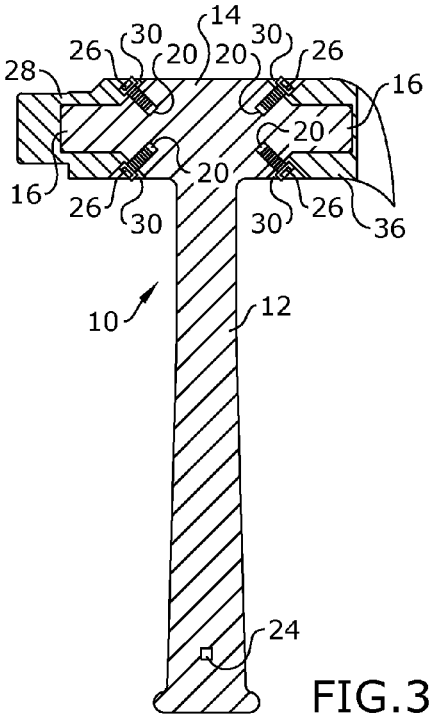
FIG. 3 is a section view of the present invention, taken along line 3-3 in FIG. 1.
Figure 4:
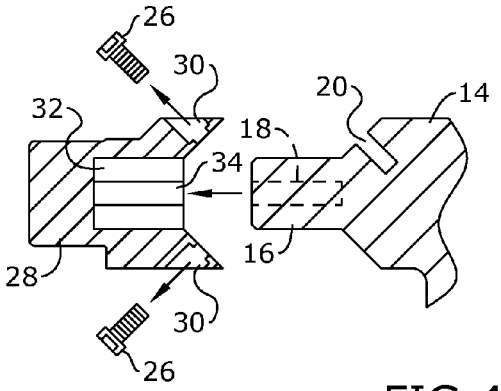
FIG. 4 is a detail section view of an embodiment of the present invention, illustrating the removal of a screw and a tool attachment.
Figure 5:
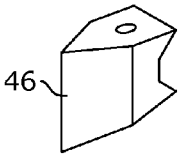
FIG. 5 is a perspective view of a tool attachment for the adaptor tool.
Figure 6:
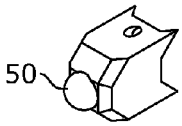
FIG. 6 is a perspective view of a tool attachment for the adaptor tool.
Figure 7:
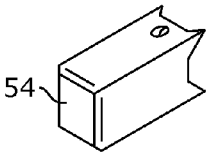
FIG. 7 is a perspective view of a tool attachment for the adaptor tool.
Figure 8:
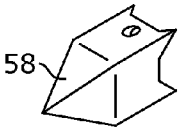
FIG. 8 is a perspective view of a tool attachment for the adaptor tool.
Figure 9:
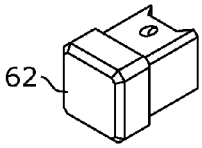
FIG. 9 is a perspective view of a tool attachment for the adaptor tool.
Figure 10:
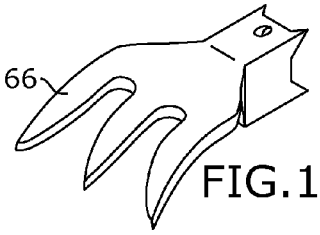
FIG. 10 is a perspective view of a tool attachment for the adaptor tool.
Figure 11:
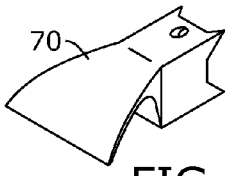
FIG. 11 is a perspective view of a tool attachment for the adaptor tool.
Figure 12:
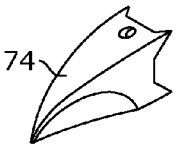
FIG. 12 is a perspective view of a tool attachment for the adaptor tool.
Figure 13:
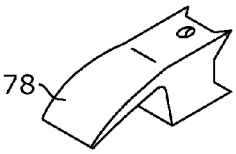
FIG. 13 is a perspective view of a tool attachment for the adaptor tool.
Figure 14:
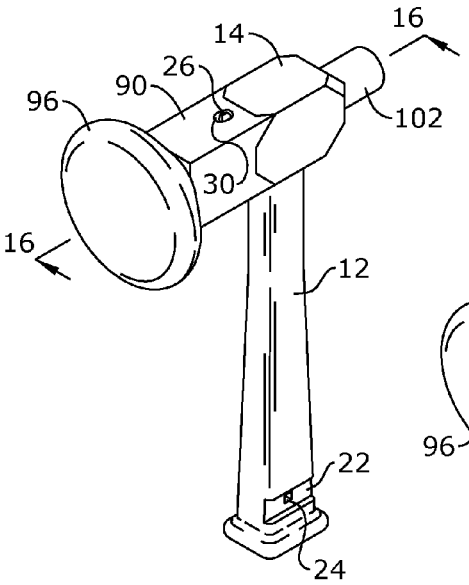
FIG. 14 is a perspective view an embodiment of the present invention, shown in use with a mallet attachment.
Figure 15:
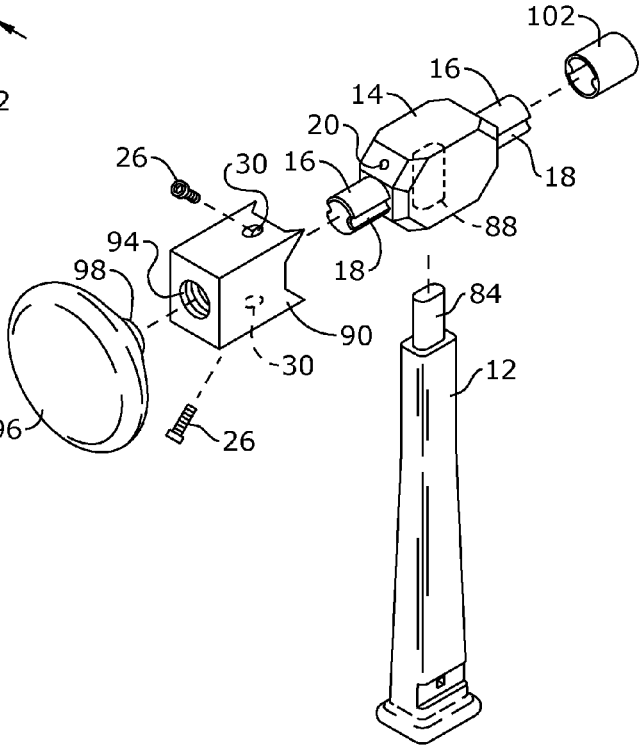
FIG. 15 is an exploded view of the embodiment of FIG. 14.
Figure 16:
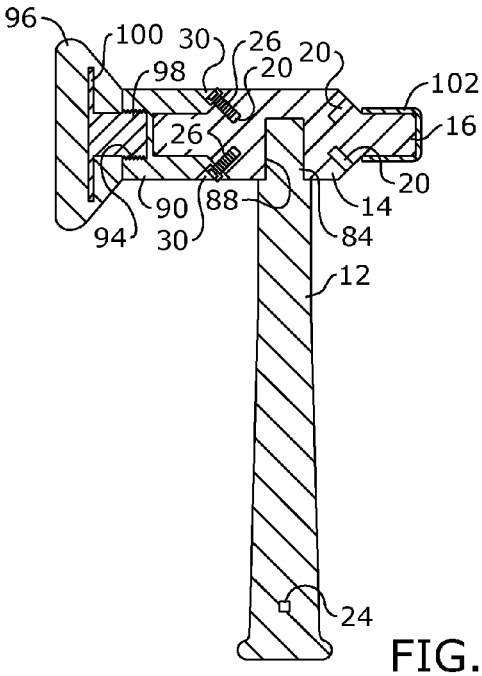
FIG. 16 is a section view of the present invention, taken along line 16-16 in FIG. 14.
Figure 17:
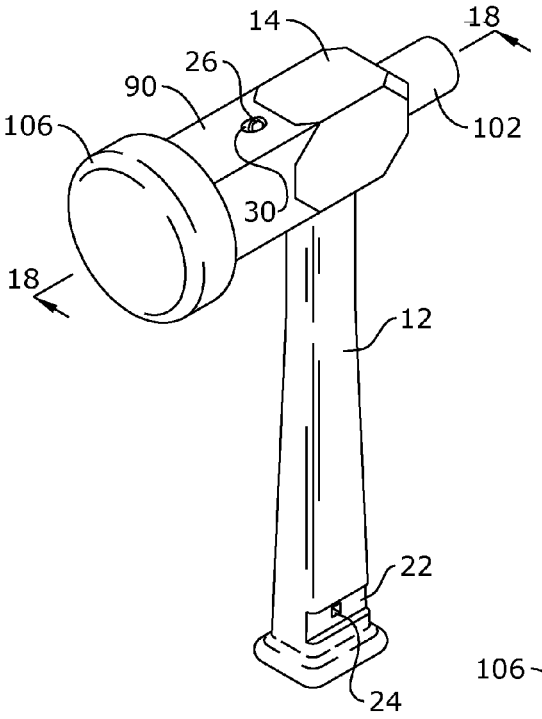
FIG. 17 is a perspective view an embodiment of the present invention, shown in use with a mallet attachment.
Figure 18:
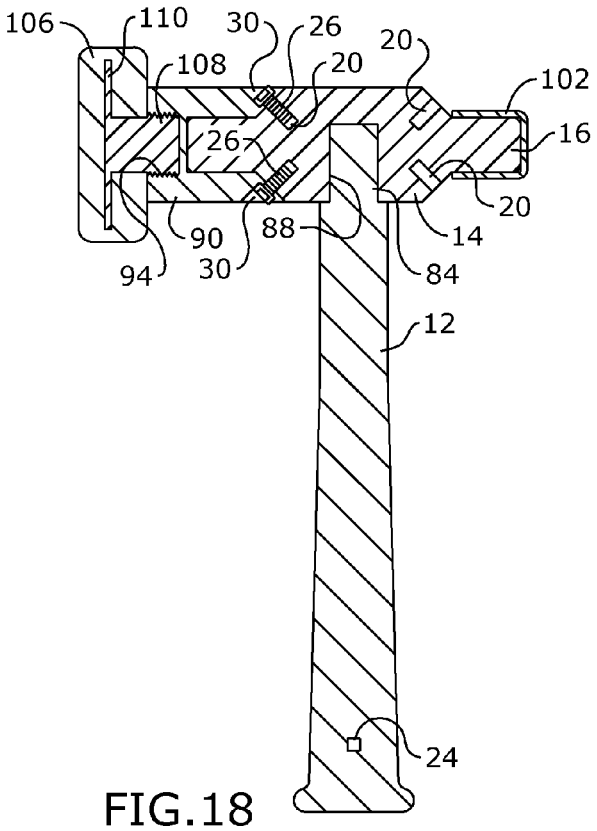
FIG. 18 is a section view of the present invention, taken along line 18-18 in FIG. 17.
Figure 19:
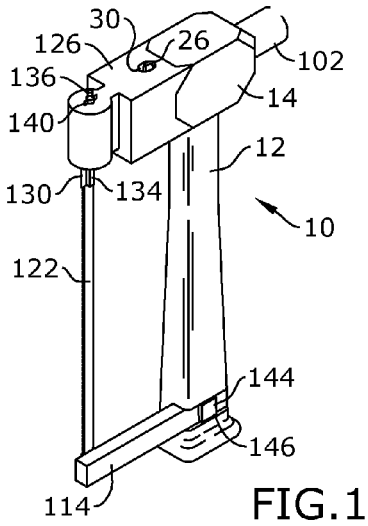
FIG. 19 is a front perspective view of an embodiment of the present invention, shown with a saw attachment.
Figure 20:
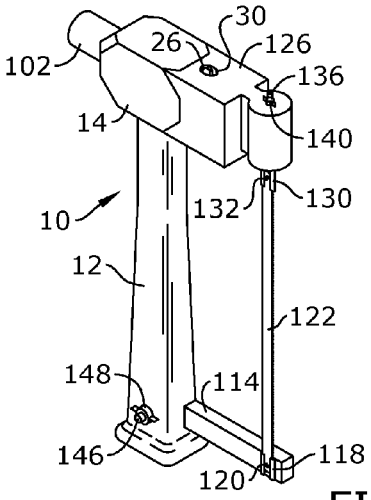
FIG. 20 is a rear perspective view of an embodiment of the present invention, shown with a saw attachment.
Figure 21:
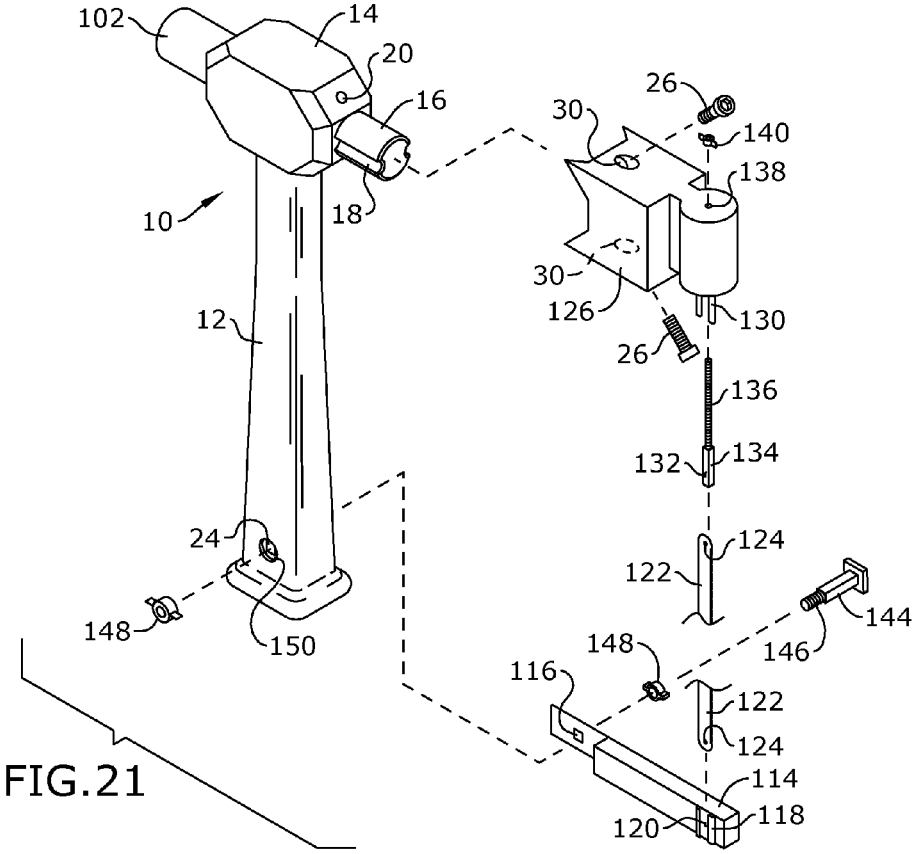
FIG. 21 is a rear exploded view of an embodiment of the present invention.
Figure 22:
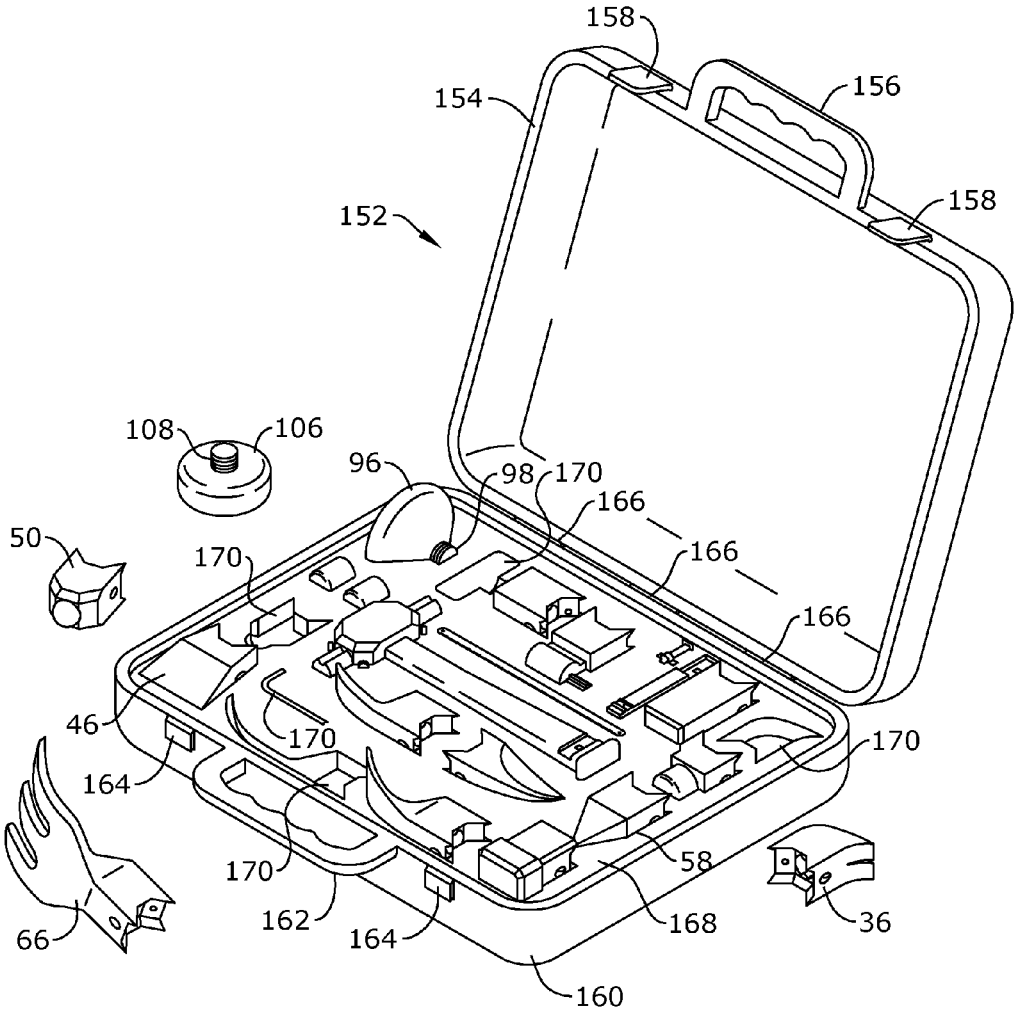
FIG. 22 is a perspective view of the present invention stored in a case, with some attachments removed from the case for illustrative clarity.

Referring to FIGS. 1 through 22, the present invention includes an adapter tool 10. The adapter tool 10 includes an elongated handle 12 having a top end opposite a bottom end. A head 14 is attached to and is substantially perpendicular with the handle 12. The head 14 includes a first end opposite a second end. At least one of the first end and the second end may include a head mating end 27. The present invention further includes a plurality of tool attachments 25. Each of the tool attachments 25 includes a tool mating end 29 releasably attachable to the head mating end 27. Each of the plurality of tool attachments 25 may include a tool portion including a different type of tool. Therefore, different tool attachments 25 may be connected to the head 14 to form different tools.

The handle 12 of the present invention may be made by a metal, fiberglass, wood or the like. A rubber sleeve may be secured over the handle 12 to provide additional comfort. The head 14 and tool attachments 25 may be made of a metal or other solid material. The head 14 may interface the tool attachments 25 to form a metal to metal even-forced distribution. The design of the present invention will be able to absorb shock and distribute force evenly. The head 14 and the handle 12 may be integral. However, in certain embodiments, the head 14 and the handle 12 may be releasably attachable. For example, the handle 12 may include a post 84 that fits within a slot 88 formed through the head 14.

As illustrated in the Figures, the first end and the second end of the head 14 may each include a head mating end 27. In such embodiments, the present invention may include a cap 102 to cover an unused head mating end 27. The head mating end 27 may include a post 16 with stabilizing channels 18 formed on either side. The post 16 may be beveled to prevent mushrooming and the head mating end 27 may also include beveled edges. The tool mating end 29 may include a slot 32 sized to receive the post 16. The slot 32 may include a stabilizing track 34 formed on either side. The track 34 and slot 32 may stabilize and center the tool attachment 25 and the head 14. When securing a tool attachment 25 to the head 14, the stabilizing track 34 aligns with the stabilizing channels 18 such that the post 16 may slide into, i.e. slidably engage with, the slot 32. The beveled edges of the tool attachment 25 may mate with the beveled edges of the head 14 so that the sidewalls of the tool attachment 25 lie flush with the sidewalls of the head 14 while attached to one another.

To further secure the tool attachment 25 to the head 14, a plurality of screws 26 may run through a plurality of aligned openings 20, 30. For example, a threaded opening 20 may be formed through a beveled edge on opposite sides of the head 14. A non-threaded opening 30 (tool opening) may be formed through a beveled edge on opposite sides of the tool attachment 25. When the post 16 is within the slot 32, the threaded openings 20 of the head 14 may be aligned with non-threaded openings 30 of the tool attachment 25. A screw 26 may run through the non-threaded opening 30 and engage the threaded opening 20 for each of the aligned threaded and non-threaded openings 20, 30, thereby securing the tool attachment 25 to the head 14.

The tool portion of the tool attachment 25 may include a variety of different tool types. The tool types may include, but are not limited to, a hammer 28, a nail puller 36, an axe 46, a ball peen hammer 50, a sledge hammer 54, a welder's hammer 58, an engineer's hammer 62, a cultivator 66, a grubbing hoe 70, a rear pick axe 74, a front pick axe 78, a mallet 96, 106, and a saw 122. In certain embodiments, the plurality of tool attachments 25 with different types of tool types may be stored in a case 152 with the handle 12 and head 14. The case 152 may include a case top 154 connected to a case bottom 160 by hinges 166. The case top 154 includes a handle 156 and the case bottom 160 includes a handle 162. The case 152 may be closed by latches 158 engaging latch strikes 164. The case 152 may include a molded insert 168 with a plurality of tool cavities 170. Each tool attachment 25 may be stored within each of the tool cavities 170.

Multiple mallets 96, 106 may be secured to the head 14 of the present invention. In such embodiments, the present invention may include a mallet adapter 90. The mallet adapter 90 includes the tool mating end 29 formed on a first end and a threaded opening 94 formed on the second end. The present invention may include a rubber mallet head 96 having a threaded post 98 that engages the threaded opening 94 and thereby releasably secures within the threaded opening 94. The rubber mallet head 96 may include a distribution plate 100 within. The present invention may further include a plastic mallet head 106 having a threaded post 108 that engages the threaded opening 94 and thereby releasably secures within the threaded opening 94. The plastic mallet head 106 may include a distribution plate 100 within.

To attach the saw 122 to the adapter tool 10, the present invention may include an upper adapter 126 and a lower adapter 114. The upper adapter 126 may include the tool mating end 29 that is releasably attachable to the head mating end 27. The upper adapter 126 may further include a vertical slot 138 with an upper blade guide 130 attached below the vertical slot 138. A bolt 134 having a top end and a bottom end may run through the vertical slot 138. The top end of the bolt 134 includes a threaded portion 136. A wing nut 140 secures to the threaded portion 136 at a top end of the slot 138, thereby securing the bolt 134 to the upper adapter 126. The wing nut 140 may also be used to adjust the tension applied to the saw 122. The bottom end of the bolt 134 may include an upper blade hook 132, which is disposed within the upper blade guide 130. The lower adapter 114 includes a first end and a second end. The first end is secured within a lower handle slot 22 formed on the second end of the handle 12. The lower adapter 114 may include an opening 116 and the handle 12 may include an opening 24. A bolt 144 may releasably secure the lower adapter 114 to the handle 12 through the aligned openings 24, 116. A winged nut 148 may screw onto a thread portion 146 of the bolt 144 and be secured within a nut recess 150. The lower adapter 116 includes a lower blade guide 118 with a lower blade hook 120 disposed within. The saw 122 may include an upper blade screw hole 124 and a lower blade screw hole 124. The blade screw holes 124 may be secured to the blade hooks 132, 120, and thereby attaches the saw 122 to the adapter tool 10.

It should be understood, of course, that the foregoing relates to exemplary embodiments of the invention and that modifications may be made without departing from the spirit and scope of the invention as set forth in the following claims.

What is claimed is:

1. An adapter tool comprising:

a handle comprising a top end and a bottom end;

a head attached to the top end of the handle and comprising a first end and a second end, wherein at least one of the first end and the second end comprises a head mating end comprising a post having a distal end and a proximal end, wherein the distal end comprises a beveled edge;

a plurality of tool attachments, each comprising:

a tool mating end comprising a slot sized to receive the post and releasably attach to the head mating end; and a tool portion opposite the tool mating end, wherein the tool portion comprises one of a hammer, a nail puller, an axe, a ball peen hammer, a sledge hammer, a welder's hammer, an engineer's hammer, a cultivator, a grubbing hoe, a rear pick axe, a front pick axe, a mallet, and a saw, wherein one of the plurality of the tool attachments comprises a saw tool portion comprising:

an upper adapter comprising the tool mating end comprising the slot sized to receive the post and releasably attach to the head mating end, and an upper blade guide;

a lower adapter releasable attachable to the bottom end of the handle and comprising a lower blade guide; and a hacksaw blade releasably attachable within the upper blade guide and the lower blade guide.

2. The adapter tool of claim 1, wherein the first end and the second end of the head each comprise the head mating end.

3. The adapter tool of claim 1, wherein at least one threaded opening is formed through one of the beveled edges of the head mating end that aligns with at least one tool opening formed in each of the plurality of tool attachments through one of the beveled edges of the tool mating end, wherein a screw runs through the tool opening and engages with the aligned threaded opening thereby releasably securing at least one of the tool attachments to the head.

4. The adapter tool of claim 1, wherein each of the plurality of tool attachments comprises a stabilizing track formed within the slot, wherein the post comprises a stabilizing channel formed to receive the stabilizing track.

5. The adapter tool of claim 1, wherein the handle comprises a lower handle slot sized to receive a portion of the lower adapter and comprising an opening aligned with an opening formed through the lower adapter, wherein a bolt releasably secures the lower adapter to the handle through the aligned openings.

6. The adapter tool of claim 1, wherein the head mating end further comprises beveled edges and the tool mating end further comprises beveled edges that mate with the beveled edges of the head mating end.

7. The adapter tool of claim 1, wherein the post comprises a cylinder shape and the beveled edge is formed circumferentially about the distal end.

8. The adapter tool of claim 1, wherein another one of the plurality of tool attachments comprises a mallet comprising:

a mallet adapter comprising the tool mating end formed on a first end and a threaded opening formed on a second end; and a mallet head comprising a threaded post releasably securable within the threaded opening of the mallet adapter.

9. The adapter tool of claim 8, wherein the mallet comprises a plastic mallet head or a rubber mallet head.

* * * * *